US005649485A

United States Patent [19]

Dour et al.

[11] Patent Number: 5,649,485

[45] Date of Patent: *Jul. 22, 1997

[54] SELF-INKING STAMP

[75] Inventors: Frederick W. Dour, Basking Ridge; Steven J. Sculler, Manalapan; Walter Stefanski, Berkeley Heights, all of N.J.

[73] Assignee: M&R Marking Systems, Inc., Piscataway, N.J.

[ * ] Notice: The term of this patent shall not extend beyond the expiration date of Pat. No. 5,517,916.

[21] Appl. No.: 639,959

[22] Filed: Apr. 29, 1996

Related U.S. Application Data

[63] Continuation of Ser. No. 305,568, Sep. 14, 1994, Pat. No. 5,517,916.

[51] Int. Cl.[6] ..... B41K 1/42

[52] U.S. Cl. ..... 101/334; 101/104

[58] Field of Search ..... 101/101, 108, 101/333, 334, 103, 104, 109, 327, 405, 406

[56] References Cited

U.S. PATENT DOCUMENTS

| | | | |
|---|---|---|---|
| 454,499 | 6/1891 | Ryer | 101/334 |
| 4,432,281 | 2/1984 | Wall et al. | 101/334 |

*Primary Examiner*—Ren Yan

*Attorney, Agent, or Firm*—Lerner, David, Littenberg, Krumholz & Mentlik

[57] ABSTRACT

Self-inking stamps and methods of reinking such stamps are disclosed. The self-inking stamps comprise a frame and a removable ink pad holder releasably mounted on the frame wherein the ink pad holder may be at least partially removed while the remaining structure of the self-inking stamp remains substantially intact to facilitate reinking of the associated ink pad.

22 Claims, 10 Drawing Sheets

SELF-INKING STAMP

This is a continuation of application Ser. No. 08/305,568, filed on Sep. 14, 1994, now U.S. Pat. No. 5,517,916.

FIELD OF THE INVENTION

The present invention relates to self-inking stamps. The present invention also relates to re-inkable ink pads for use with self-inking stamps. More particularly, the present invention relates to self-inking hand stamping devices which include operatively associated frame members and operating members. Still more particularly, the present invention relates to self-inking hand stamping devices of this nature which include an invertible stamp carrying platen and an ink pad holder relative to the frame member in which constant and reliable stamping can be continuously provided with ink being continuously applied to the stamp die in relatively constant amounts during each stamping operation.

BACKGROUND OF THE INVENTION

Self-inking hand stamping devices of the general type described above have been known for many years. Many of these devices are discussed in the background section of U.S. Pat. Nos. 4,432,281 and 4,852,489, which were issued to the assignee of the present application in 1984 and 1989, respectively.

The devices shown in the '281 and '489 patents have provided important commercial improvements in self-inking hand stamping devices as compared to the prior art discussed in the background section of those patents for many of the reasons discussed therein. These include the ability to grasp the device in a person's hand from any direction about the device, and then easily being placed for use and operation by the same hand position; the ability to display indicia or information of a stamp to be impressed by the device, with the indicia being legible in more than one direction; the ability to accommodate indicia covering the width of the stamp carrying platen of the device so that the full imprint of the stamp as wide as the platen can be displayed; and the ability to replenish the ink supply of the pad when it becomes dry without soiling one's fingers with ink.

These and other objects were accomplished by the device shown, for example, in the '281 patent by providing a self-inking stamping device which is easily grasped and operated by the user engaging opposite sides of an operating upper member from any direction at any location about the device; by providing an operating member with a closure over the top sloped outwardly in the upward direction from the bottom to the top and merging with the closure; providing for presentation of a flat upwardly facing top surface which has approximately the same width and length as the open area of the device where the stamp platen operates, and having a sloped surface defining a front of the device which becomes readily apparent to the user for orientation purposes; and by providing accessibility to the ink pad holder from the top of the operating member for re-inking without removal of the ink pad or for removal of the entire ink pad for replacement through the top closure.

While these devices have thus proven to be extremely successful on a commercial basis, the need has continued for more improved self-inking hand stamping devices of this type. For example, in the device shown in the '281 patent the springs which activate the device are compressed between the ink pad and a bridge affixed to a rim at the top of the operating member. In this manner, when the cover is removed the springs remain active, and impinge directly upon the ink pad itself. While this has some advantages, it has the disadvantage of requiring that, in order to replace the ink pad, the bridge member must be detached from the rim, and lifted out of the encasement. Then, a used ink pad holder which is to be removed must be flicked off the gripping spring coils with a pencil or other such instrument and replaced with a new ink pad holder, such as to change colors of the imprints and the like.

There also exist prior art self-inking stamps which include removable ink pads. For example, in prior art devices such as those shown in U.S. Pat. Nos. 1,345,255 and 1,042,766, as well as in commercially available devices such as a metal self-inking stamp manufactured by Colop, the ink pads are removable for replacement purposes. The latter device is also represented by U.S. Pat. Nos. 5,058,501 and 4,823,696. In addition, a plastic self-inking stamp with a removable ink pad is sold under the name Printy, by Trodat. However, in each of these prior art devices, it is possible to inadvertently remove the ink pad during use, and in these devices it is difficult to handle these ink pads without risking the soiling of the user's fingers. Furthermore, many of these devices do not provide the option of re-inking either with or without removal of the ink pad from the device itself.

Thus, the search has continued for a self-inking device in which the springs do not necessarily remain active upon removal of the cover, and which at the same time preferably do not rest on the ink pad itself, which can thus be readily removed, either for replacement or re-inking.

In addition, while in some instances it may be desirable to include a spring mechanism in these devices which is affixed to a portion of the frame member upon removal of the cover, so that they are rendered inactive thereupon, at the same time, this must be done in a manner which makes it easy to replace the cover and put the device back into its active configuration.

Furthermore, since the development of the device shown in the '281 patent, further improved ink pads have been devised, and these ink pads no longer require use of the type of pockets 24 shown in the '281 patent enclosing ink receptive material, such as disks or pads of felt, to aid in distribution of the ink from the pockets into the main body of the ink pad as shown therein.

It is also desirable to provide such self-inking stamp devices utilizing these ink pads which are cleaner and more reliable for removal, and which cannot be inadvertently removed from the device.

SUMMARY OF THE INVENTION

These and other objects have now been realized by the invention of a self-inking stamp which includes a frame member having a lower end for contacting a support surface and an upper end, an operating member operatively associated with and vertically displaceable with respect to the frame member between upper and lower positions with respect to the frame member, the operating member including an upper end, ink pad means for removably supporting an ink pad at the upper end of the frame member, stamp die means for displaceably mounting a stamp die within the frame member, turnover means for causing the stamp die means to be displaced between a first position in which the stamp die is in contact with the ink pad and the operating member is in its upper position with respect to the frame member, and a second position in which the stamp die is in a stamping position at the support surface when the operating member is in the lower position with respect to the frame member, and spring means affixed to the ink pad means and normally compressed between the operating member and the ink pad means whereby the ink pad can be removed from the frame member without removing the ink pad means and the spring means holds the operating member in its upper position from which the operating member can be pressed downwardly against the spring means relative to the frame member into the lower position in order to effect stamping therewith.

In accordance with one embodiment of the self-inking stamp of the present invention, the operating member includes a cover member removably fitted at the upper end of the operating member, and in which the spring means is normally compressed between the cover member and the ink pad means, whereby upon removal of the cover means the spring means remains affixed to the ink pad means and is rendered inactive.

In accordance with a preferred embodiment of the self-inking stamp of the present invention, the ink pad is carried by a removable tray, and the ink pad means includes enclosure means including a wall portion separating the removable tray from the upper end of the operating member, the removable tray being slidably engaged with the upper end of the frame member below the wall portion of the enclosure means, the upper end of the frame member further including slot means through which the removable tray can be removed from the frame member, the spring means being affixed to the wall portion of the enclosure means.

In a preferred embodiment, the wall portion of the enclosure means extends from the frame member, and is preferably integral therewith.

In accordance with another embodiment of the self-inking stamp of the present invention, the removable tray includes handle means for grasping the removable tray for removal through the slot means. In another embodiment, the slot means comprises first and second slot members on either side of the frame member whereby the removable tray can be removed through the first slot member by applying pressure through the second slot member.

In accordance with another embodiment of the self-inking stamp of the present invention, the enclosure means further includes temporary locking means for temporarily locking the removable tray in the upper end of the frame member whereby the removable tray must be unlocked before it can be removed from the frame member through the slot means. In a preferred embodiment, the temporary locking means comprises downwardly extending wall means preventing horizontal sliding of the removable tray through the slot means. In a more preferred embodiment, the temporary locking means further includes interlocking means disposed on the downwardly extending wall means and the removable tray.

In accordance with a preferred embodiment of the self-inking stamp of the present invention, the slot means is a first slot and the operating member includes a first wall portion which extends below the first slot in the upper portion of the frame member, thereby blocking the first slot when the operating member is in the upper position with respect to the frame means, and the operating member further includes a second slot, whereby the removable tray can be removed from the frame member only when the first and second slots are in alignment with each other.

In accordance with another embodiment of the self-inking stamp of the present invention in which the operating member includes a cover member removably fitted to its upper end, the ink pad includes a front surface for contact with the stamp die, and a rear surface, and the removable tray includes inking means on the rear surface of the ink pad for receiving ink and distributing the ink into the ink pad, whereby the inking means may be accessed so that ink may be supplied to the ink pad upon removal of the cover member.

In accordance with another embodiment in which the operating member includes a cover member removably fitted at the upper end of the operating member, the device further includes bridge means affixed to and spanning the upper end of the operating member, whereby the spring means is normally compressed between the bridge means and the ink pad means, whereby upon removal of the cover member the spring means remains active.

In accordance with another embodiment, the self-inking stamp of the present invention includes a frame member having a lower end for contacting a support surface and an upper end, an operating member operatively associated with and vertically displaceable with respect to the frame member between upper and lower positions with respect to the frame member, the operating member including an upper end and a cover member removably fitted at the upper end of the operating member, ink pad means for removably supporting an ink pad at the upper end of the frame member, stamp die means for displaceably mounting a stamp die within the frame member, turnover means for causing the stamp die means to be displaced between a first position in which the stamp die is in contact with the ink pad and the operating member is in its upper position with respect to the frame member, and a second position in which the stamp die is in a stamping position at the support surface when the operating member is in the lower position with respect to the frame member, and spring means affixed to the ink pad means and normally compressed between the cover member and the ink pad means whereby the spring means holds the operating member in its upper position from which the operating member can be pressed downwardly against the spring means relative to the frame member into the lower position in order to effect stamping therewith, and upon removal of the cover member the spring means remains affixed to the ink pad means and is rendered inactive.

In accordance with a preferred embodiment of this embodiment of the self-inking stamp of the present invention, the ink pad is carried by a removable tray, and the ink pad means includes enclosure means including a wall portion separating the removable tray from the upper end of the operating member, the removable tray being slidably engaged with the upper end of the frame member below the wall portion of the enclosure means, the upper end of the frame member further including slot means for removing the removable tray from the frame member, the spring means being affixed to the wall portion of the enclosure means.

In a preferred embodiment, the wall portion of the enclosure means extends from the frame member, and is preferably integral therewith.

In accordance with another embodiment of the present invention, a self-inking stamp has been devised which includes a frame member having a lower end for contacting a support surface and an upper end, an operating member operatively associated with and vertically displaceable with respect to the frame member between upper and lower positions with respect to the frame member, the operating member including an upper end, ink pad means for supporting an ink pad at the upper end of the frame member, the ink pad means comprising a removable tray for carrying the ink pad, and enclosure means including a wall portion separating the removable tray from the upper end of the operating member, the removable tray being slidably engaged with the upper end of the frame member below the wall portion of the enclosure means, the upper end of the frame member further including slot means for removing the removable tray from the frame member, stamp die means for displaceably mounting a stamp die within the frame member, turnover means for causing the stamp die means to be placed between a first position in which the stamp die is in contact with the ink pad when the operating member is in the upper position with respect to the frame member and a second position in which the stamp die is in a stamping position at the support surface when the operating member is in the lower position with respect to the frame member, and spring means affixed to the wall portion of the ink pad means and normally compressed between the operating member and the wall portion of the ink pad means, whereby the spring means holds the operating member in its upper position from which the operating member can be pressed downwardly against the spring means relative to the frame member into the lower position to effect stamping therewith.

In accordance with another embodiment of the present invention, a self-inking stamp has been devised which includes a frame member having a lower end for contacting a support surface and an upper end and having a first wall including first slot means, an operating member operatively associated with and vertically displaceable with respect to the frame member between upper and lower positions with respect to the frame member, the operating member including a downwardly depending first wall portion corresponding to the first wall portion of the frame member and including second slot means, ink pad means for supporting an ink pad at the upper end of the frame member, the ink pad means comprising a removable tray for carrying the ink pad, the removable tray being slidably engaged with the upper end of the frame member for removal through the first and second slot means, stamp die means for displaceably mounting a stamp die within the frame member, turnover means for causing the stamp die means to be displaced between a first position in which the stamp die is in contact with the ink pad and the operating member is in an upper position with respect to the frame member and a second position in which the stamp die is in a stamping position at the support surface when the operating member is in its lower position with respect to the frame member, and spring means normally compressed between the operating member and the ink pad means whereby the spring means holds the operating member in its upper position from which the operating member can be pressed downwardly against the spring means relative to the frame member into its lower position in order to effect stamping therewith, the operating member including barrier means for preventing the removable tray from being removed through the second slot means when the operating member is in its upper position.

In accordance with one embodiment of this self-inking stamp of the present invention, the barrier means is a portion of the downwardly depending first wall portion of the operating members which normally covers the first slot means when the operating member is in its upper position, whereby the removable tray can be removed through the first and second slot means upon depression of the operating member to a predetermined position in which the first slot means is in alignment with the second slot means and out of alignment with the barrier means.

In accordance with another preferred embodiment of this self-inking stamp of the present invention, the operating member includes a cover member removably fitted at the upper end of the operating member, and the barrier means comprises a portion of the cover member which normally covers the second slot means whereby the removable tray can be removed through the first and second slot means by removing the cover member.

In accordance with another embodiment of this self-inking stamp of the present invention, the removable tray includes handle means for grasping the removable tray for removal through the first and second slot means.

In accordance with another embodiment of this self-inking stamp of the present invention, the spring means is affixed to the ink pad means.

In accordance with another embodiment of this self-inking stamp of the present invention, the frame member includes a second wall opposite the first wall and includes second slot means, and the operating member includes a second wall portion corresponding to the second wall portion of the frame member and includes second slot means, whereby the removable tray may be removed through the first slot members by applying pressure through the second slot members.

In accordance with another embodiment of this self-inking stamp of the present invention, the frame means further includes locking means for locking the removable tray in the upper end of the frame member whereby the removable tray must unlock before it can be removed from the frame member through the first and second slot means. In a preferred embodiment, the locking means comprises downwardly extending wall means preventing horizontal sliding of the removable tray through the first and second slot means. In a highly preferred embodiment, the locking means further includes interlocking means disposed on the downwardly extending wall means and the removable tray.

In accordance with another embodiment of this self-inking stamp of the present invention, the operating member includes a cover member removably fitted at the upper end of the operating member, and in which the spring means is affixed to the ink pad means and is normally compressed between the cover member and the ink pad means, whereby upon removal of the cover member the spring means remains affixed to the ink pad means and is rendered inactive.

In accordance with another embodiment of this self-inking stamp of the present invention, the ink pad means further comprises enclosure means including a wall portion separating the removable tray from the upper end of the operating member, the removable tray being slidably engaged with the upper end of the frame member below the wall portion of the enclosure means, and the spring means is affixed to the wall portion of the enclosure means. In a preferred embodiment, the wall portion of the enclosure means extends from the frame member and is integral therewith.

In accordance with another embodiment of this self-inking stamp of the present invention, the ink pad includes a front surface for contact with the stamp die and a rear surface, and the removable tray includes inking means on the rear surface of the ink pad for receiving ink and distributing the ink into the ink pad whereby the inking means may be accessed so that ink may be supplied to the ink pad upon removal of the cover member.

In accordance with yet another embodiment of the self-inking stamp of the present invention, the operating member includes a cover member removably fitted at the upper end of the operating member, and bridge means affixed to and spanning the upper end of the operating member whereby the spring means is normally compressed between the bridge means and the ink pad means, whereby upon removal of the cover member the spring means remains active.

In accordance with another embodiment of the present invention, a self-inking stamp has been devised which includes a frame member having a lower end for contacting a support surface and an upper end, an operating member operatively associated with and vertically displaceable with respect to the frame member between upper and lower positions with respect to the frame member, the operating member including an upper end, ink pad means for removably supporting an ink pad at the upper end of the frame member, the ink pad including a front surface and a rear surface and being carried by a removable tray slidably engaged with the upper end of the frame member, the upper end of the frame member including slot means for removing the removable tray from the frame member, the removable tray including inking means on the rear surface of the ink pad for receiving ink and distributing the ink into the ink pad, stamp die means for displaceably mounting a stamp die within the frame member, turnover means for causing the stamp die means to be displaced between a first position in which the stamp die is in contact with the front surface of the ink pad when the operating member is in its upper position with respect to the frame member and a second position in which the stamp die is in a stamping position at the support surface when the operating member is in its lower position with respect to the frame member, and spring means normally compressed between the operating member and the ink pad means whereby the ink pad can be removed from the frame member without removing the ink pad means and the spring means holds the operating member in its upper position from which the operating member can be pressed downwardly against the spring means relative to the frame member into its lower position in order to effect stamping therewith.

In accordance with a preferred embodiment of this self-inking stamp of the present invention, the operating member includes a cover member removably fitted at the upper end of the operating member, and the spring means is normally compressed between the cover member and the ink pad means.

In accordance with another embodiment of this self-inking stamp of the present invention, the operating member includes a cover member removably fitted at the upper end of the operating member and bridge means affixed to and spanning the upper end of the operating member wherein the spring means is normally compressed between the bridge means and the ink pad means.

In accordance with a preferred embodiment of this self-inking stamp of the present invention, the ink pad means includes enclosure means including a wall portion separating the removable tray from the upper end of the operating member, the removable tray being slidably engaged with the upper end of the frame member below the wall portion of the enclosure means.

In accordance with another embodiment of this self-inking stamp of the present invention, the spring means is affixed to the ink pad means. Preferably, the operating member includes a cover member removably fitted at the upper end of the operating member, and the spring means is normally compressed between the cover member and the ink pad means, whereby upon removal of the cover member the spring means remains affixed to the ink pad means and is rendered inactive.

In accordance with one embodiment of this self-inking stamp of the present invention, the slot means comprises a first slot and the operating member includes a first wall portion which extends below the first slot in the upper portion of the frame member thereby blocking the first slot when the operating member is in its upper position with respect to the frame means, the operating member further including a second slot whereby the removable tray can be removed from the frame member only when the first and second slots are in alignment with each other.

In a preferred embodiment of the self-inking stamp of the present invention, the operating member includes barrier means for preventing the removable tray from being removed through the second slot means when the operating member is in its upper position. In another embodiment of this self-inking stamp of the present invention, the barrier means comprises a portion of the first wall portion of the operating member which normally covers the first slot when the operating member is in its upper position, whereby the removable tray can only be removed through the first and second slots upon depression of the operating member to a predetermined position in which the first slot is in alignment with the second slot and out of alignment with the barrier means. In another embodiment, the operating member includes a cover member removably fitted at the upper end of the operating member, and the barrier means comprises a portion of the cover member which normally covers the slot, whereby the removable tray can only be removed through the first and second slots by removing the cover member.

In accordance with a preferred embodiment of the present invention, a self-inking stamp comprising a frame and a removable ink pad holder is provided. The removable ink pad holder is preferably releasably mounted on the frame in a manner sufficient to permit it to be easily removed therefrom while the additional structure of the self-inking stamp remains substantially intact. To this end, the removable ink pad holder may be at least partially removed from its mounted position on the frame while springs or other components of the self-inking stamp remain in an assembled position. In accordance with this preferred embodiment of the present invention, an ink pad is also provided and is retained by the removable ink pad holder for providing ink impressions during operation of the self-inking stamp. The removable ink pad holder includes inking means for receiving and facilitating the distribution of ink to the ink pad while the removable ink pad holder is at least partially disassembled from the frame.

In a preferred embodiment, the inking means may be arranged to allow reinking of the ink pad while the removable ink pad holder is mounted on the frame. In still a further preferred embodiment, the inking means may comprise at least one open cup member arranged on the removable ink pad holder.

In still another preferred embodiment, the removable ink pad holder may comprise a tray defining a cavity wherein the ink pad is secured to the tray within the cavity. The ink pad holder may also include handle means for facilitating removal of the ink pad holder from its assembled position on the frame.

A method of reinking a self-inking stamp is provided in accordance with a further aspect of the present invention. One preferred method may comprise the steps of at least partially removing an ink pad holder and an accompanying ink pad from the self-inking stamp while the additional structure of the self-inking stamp remains substantially intact. The method also comprises placing ink through inking means of the ink pad holder to be absorbed by the ink pad while the ink pad holder is at least partially disassembled from the self-inking stamp.

In accordance with a preferred method, the step of removing the ink pad holder and the accompanying ink pad comprises sliding the ink pad holder out of its assembled position on a frame of the self-inking stamp. In an embodiment wherein the inking means comprises at least one open cup member, the step of placing ink on the ink pad may comprise placing ink through the at least one cup member.

In accordance with a preferred embodiment wherein the ink pad holder comprises handle means, the step of removing the ink pad holder and the accompanying ink pad may comprise grasping the handle and sliding the ink pad holder away from the frame of the self-inking stamp. In another preferred embodiment, the step of removing the ink pad holder may comprise disassembling the ink pad holder from its assembled position on the frame of the self-inking stamp wherein such disassembly may comprise steps other than simply sliding the ink pad holder out of its assembled position. For example, the ink pad holder may initially be pulled down from its mounted position on an associated frame.

BRIEF DESCRIPTION OF THE DRAWINGS

The self-inking stamp devices of the present invention may be more readily understood with reference to the following detailed description, in which reference is made to the Figures, wherein.

DETAILED DESCRIPTION

Figure 1:
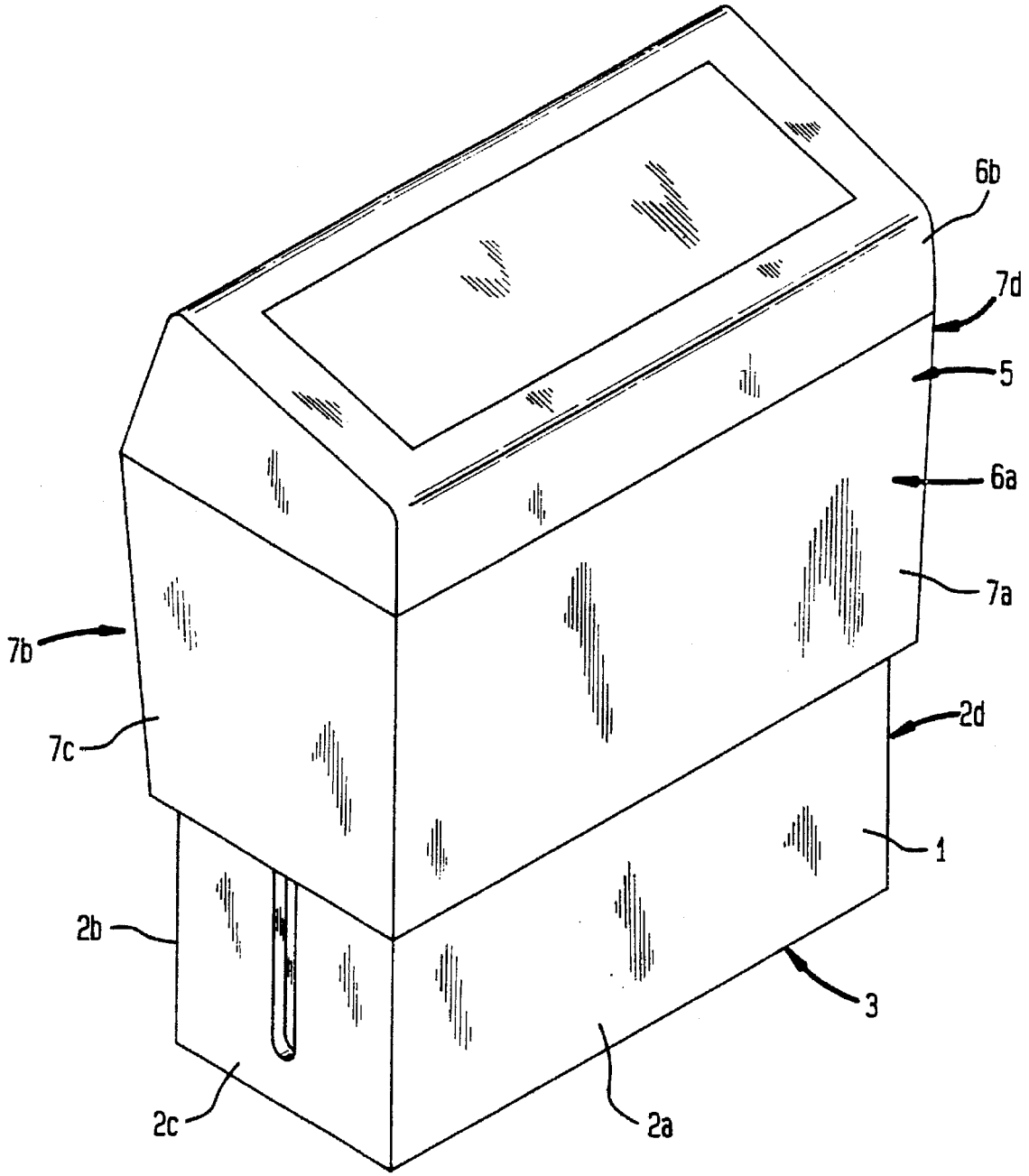
FIG. 1 is a front perspective view of a self-inking stamp in accordance with the present invention.

Referring to the Figures, in which like numerals refer to like elements thereof, FIG. 1 shows a self-inking stamp of the present invention including a frame member 1 which is preferably an upright hollow rectangular member which has a lower end 3. The frame member 1 is hollow and includes a front wall 2*a*, a rear wall 2*b*, and side walls 2*c* and 2*d*, providing an overall rectangular configuration. The lower end 3 is intended to bear against a supporting surface. An operating member 5 is operatively associated with the frame member 1, and interfits with the frame member 1 so as to be vertically displaceable relative thereto. In the embodiment shown in FIG. 1, the operating member 5 includes a two-piece structure including a hollow encasement 6*a*, which surrounds the frame member 1, and a closure 6*b*, which is removably fitted over the top of the encasement 6*a*. The hollow encasement 6*a* also has a generally rectangular configuration, including a front wall 7*a*, a rear wall 7*b*, and side walls 7*c* and 7*d*. Each of parts 6*a* and 6*b* of operating member 5 is preferably made of a one-piece construction of a suitably rigid and durable molding of any suitable plastic material, for example, of an acrylonitrile-butadiene-styrene resin known as ABS.

Figure 3:
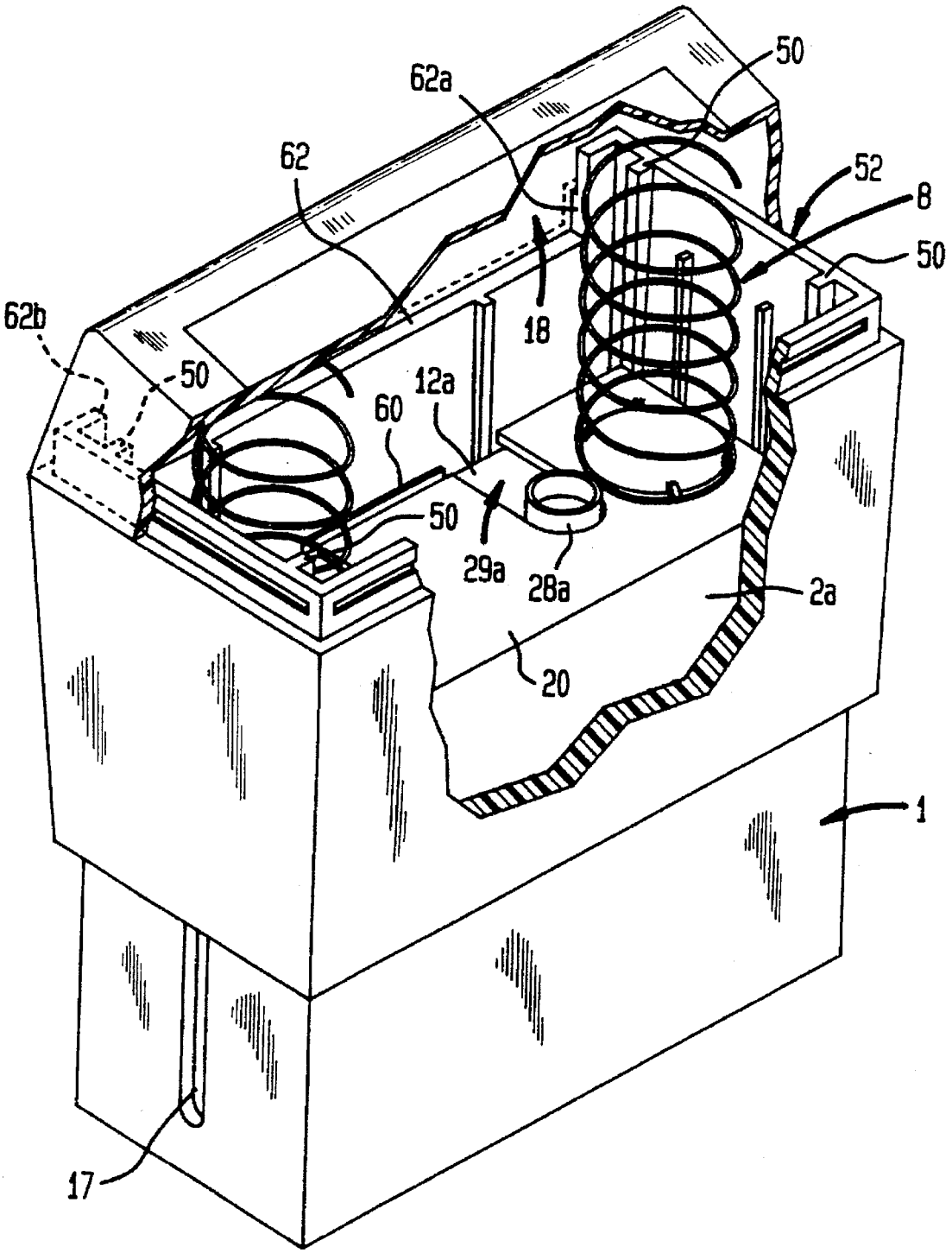
FIG. 3 is a front perspective, partially cut-away view of the self-inking stamp shown in FIG. 1.
Figure 5:
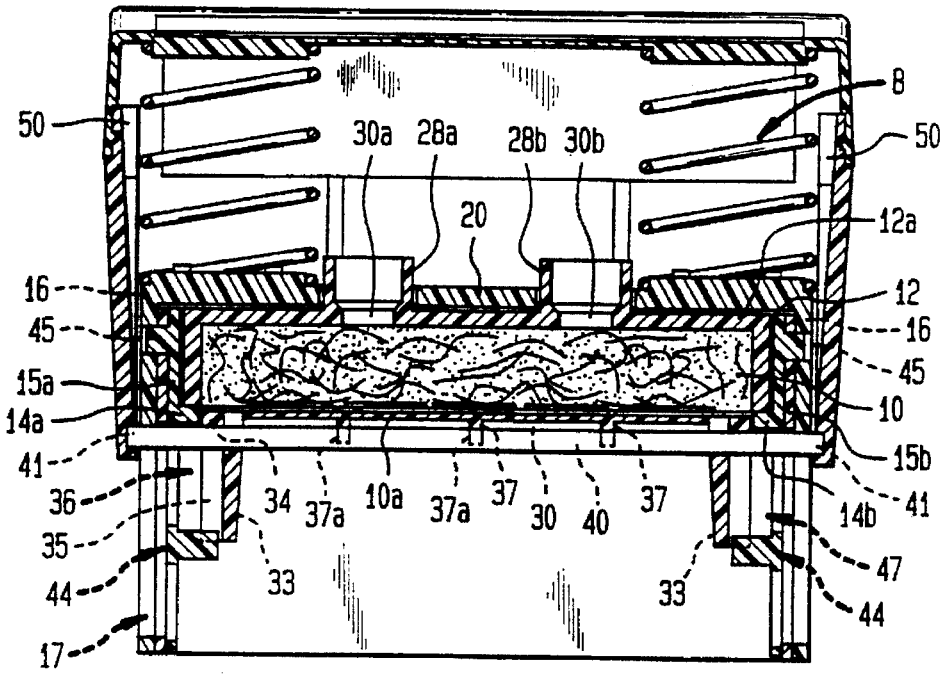
FIG. 5 is a front cross-sectional view of another embodiment of the self-inking stamp of the present invention.
Figure 7:
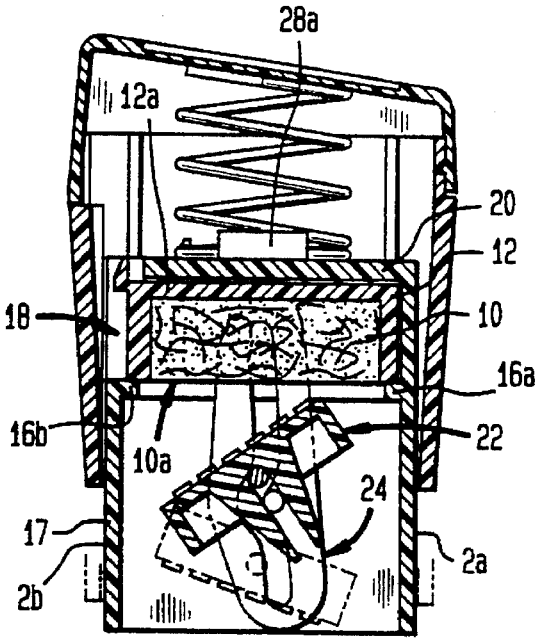
FIG. 7 is a side cross-sectional view of the self-inking stamp shown in FIG. 6, with the stamp die shown in two intermediate positions between its upper and lower positions, the second position shown in phantom thereon.

As can be seen in FIGS. 3 and 5, for example, the operating member 5 is normally held in an upward position with respect to the frame member 1 by means of spring means 8. From this configuration it is thus possible to actuate the self-inking stamp of the present invention by thrusting downwardly by one's hand against the operating member 5 relative to the frame member 1 to a stamping position, such as that shown by the phantom lines representing the lower location of the operating member in FIG. 7.

In prior art devices, such as those shown in the '281 patent, an ink pad holder containing an ink pad is supported by the frame member 1 at a distance above the lower end thereof. In the self-inking stamps of the present invention, the ink pad shown in the drawings is indicated by reference numeral 10, and is carried by a removable tray 12. The removable tray 12 carrying the ink pad 10 is removably supported at the upper end of the frame member 1. The removable tray 12 preferably encloses the ink pad 10 on five of its six sides; i.e., all sides except for its flat inking surface 10*a* (see FIG. 5). Removable tray 12 thus includes an upper surface 12*a*, depending front and rear side walls 12*b* and 12*c*, and depending left and right side walls 12*d* and 12*e*, as can best be seen in FIG. 4. This removable tray 12, along with its ink pad 10, is removably supported at the upper end of frame member 1 by means of a pair of side flanges 14*a* and 14*b* as shown in FIG. 5, extending from the inside surface of side walls 2*c* and 2*d* of the frame member 1. The removable tray 12 is further maintained in its position at the upper end of frame member 1 by means of front flange 16*a* and rear flange 16*b* extending from front wall 2*a* and the rear wall 2*b* of the frame member 1, respectively. In this manner, the removable tray 12 can be slidably removed from its position at the upper end of frame member 1 through rear slot 18 therein.

The removable tray 12 is further contained within an extending top wall 20 which extends from the front wall 2*a* of the frame member 1, and is preferably integral therewith.

Figure 6:
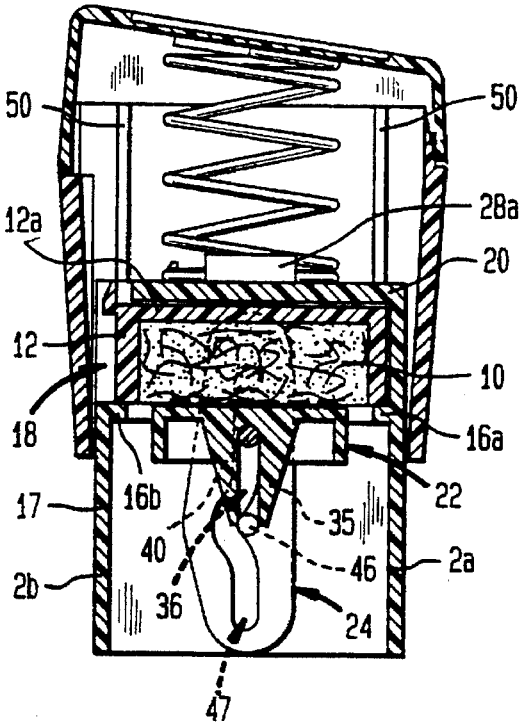
FIG. 6 is a side cross-sectional view of the self-inking stamp shown in FIG. 5, with the stamp die in its upper position.

The basic mechanism for the stamp die carrying platen used in the various embodiments of the present invention shown in the drawings is the same as that used in the '281 patent. Thus, referring specifically to FIGS. 6 and 7, a displaceable stamp die carrying platen 22 is located inside frame member 1 in the space between its lower end and the inking face 10*a* of ink pad 10. Furthermore, coacting means 24 of a generally known nature, having parts connected respectively with the stamp die carrying platen 22, the frame member 1, and the operating member 5 are provided for disposing the platen in an inking position at the ink pad 10 when the operating member 5 is in its normal, upward position, and disposing the platen in an inverted position to impress a surface at the lower end 3 of the frame member 1 when the operating member is depressed to its stamping position. It is contemplated, however, that other mechanisms can be devised and utilized for accomplishing the same result in place of this mechanism which is specifically shown in the '281 patent.

The removable tray 12 holding the ink pad 10 in its downwardly facing position seated on flanges 14*a*, 14*b*, 16*a*, and 16*b*, again includes a top wall portion 12*a*. This top wall portion 12*a* is formed with at least one and preferably two upwardly facing open cup formations 28*a* and 28*b*, as can best be seen in FIG. 5. In prior art such as the devices shown in the '281 patent, it was thus necessary to include additional pockets between the ink pad itself and these open cup formations, and include in these pockets ink receptive material, such as disks or pads of felt, to aid in distribution of the ink from the pockets into the main body of the ink pad itself. However, in view of the nature of the ink pads which have now been developed, such as reticulated foam pads, it is now possible to entirely eliminate these pockets so that the ink will flow directly from these open cup formations 28*a* and 28*b* into the ink pad 10 itself. Each of these open cup formations 28*a* and 28*b* can thus receive a limited quantity of ink for dissemination into the ink pad 10. Each of these cup formations is provided in order to hold a few drops of ink as required for the ink pad of the stamp. When the ink pad 10 thus needs to be re-inked, whether this is by removal of removable tray 12 itself from the frame member 1, or by removal of the cover member 6*b* for re-inking of the removable tray 12 in place through the top of the device, one can merely drop ink into each of the cups 28*a* and 28*b* until the cup is nearly full, and the ink will then be drawn through the openings 30*a* and 30*b* in the top surface 12*a* of the removable tray 12 into the ink pad 10.

As discussed above, operation of the stamp die carrying platen 22 and its displacement from an upper inking position at the face of the ink pad 10 to the inverted stamping position at the lower end 3 of the frame member 1 where the stamp indicia on the stamp die will impress against a surface at that lower end, by the action of the mechanism generally indicated at 24, which is, in turn, operated by downward movement of the operating member 5 relative to the frame member 1 against the force of the spring means 8, is a conventional mechanism, and is specifically shown in the '281 patent. The operation of this turnover mechanism is thus specifically described in the '281 patent, beginning at column 4, line 14 and extending through column 5, line 28 of the '281 patent, the disclosure of which is incorporated herein by reference thereto.

The particular reference numerals for the elements of this turnover mechanism are shown in the Figures in the present application with dotted lead lines using the same reference numerals as those used in the '281 patent.

Figure 2:
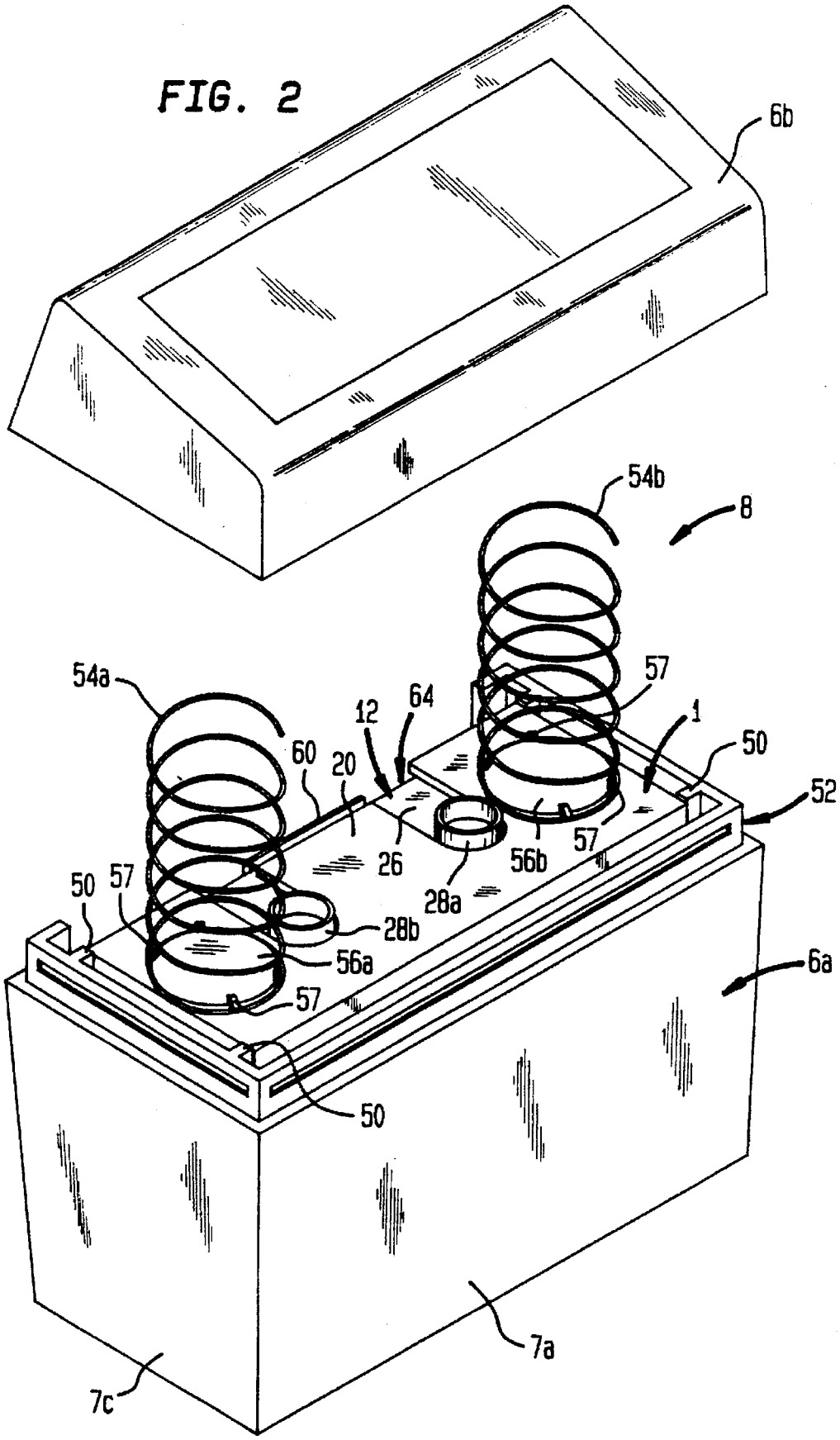
FIG. 2 is a front perspective, exploded view of the self-inking stamp shown in FIG. 1.

As can be seen in FIGS. 2 and 5, the hollow encasement 6*a* surrounding the frame member 1 and the elongated slots 17 are vertically deep enough so that the encasement 6*a* of the operating member 5 encompasses substantially the entirety of the frame member 1 when depressed to its stamping position. Operation of the device, as in the past, is thus readily accomplished by grasping the device by fingers engaging opposite sides of the encasement at any location about the device, or even in the palm of the hand, and then with the same grasp, without changing position, pressing the device at the desired imprint location and operating the device in the manner discussed above.

The encasement 6*a* of the operating member 5 includes walls which are molded with substantially uniform thickness, and which include inward protrusions such as vertically extending ribs 50 which deepen in the upward direction and are provided along the inner sides of these walls of the operating member 5. Preferably, these ribs are included on both the end and side walls thereof, and therefore completely contain and control the slidable displacement between the frame member 1 and the operating member 5.

Figure 4:
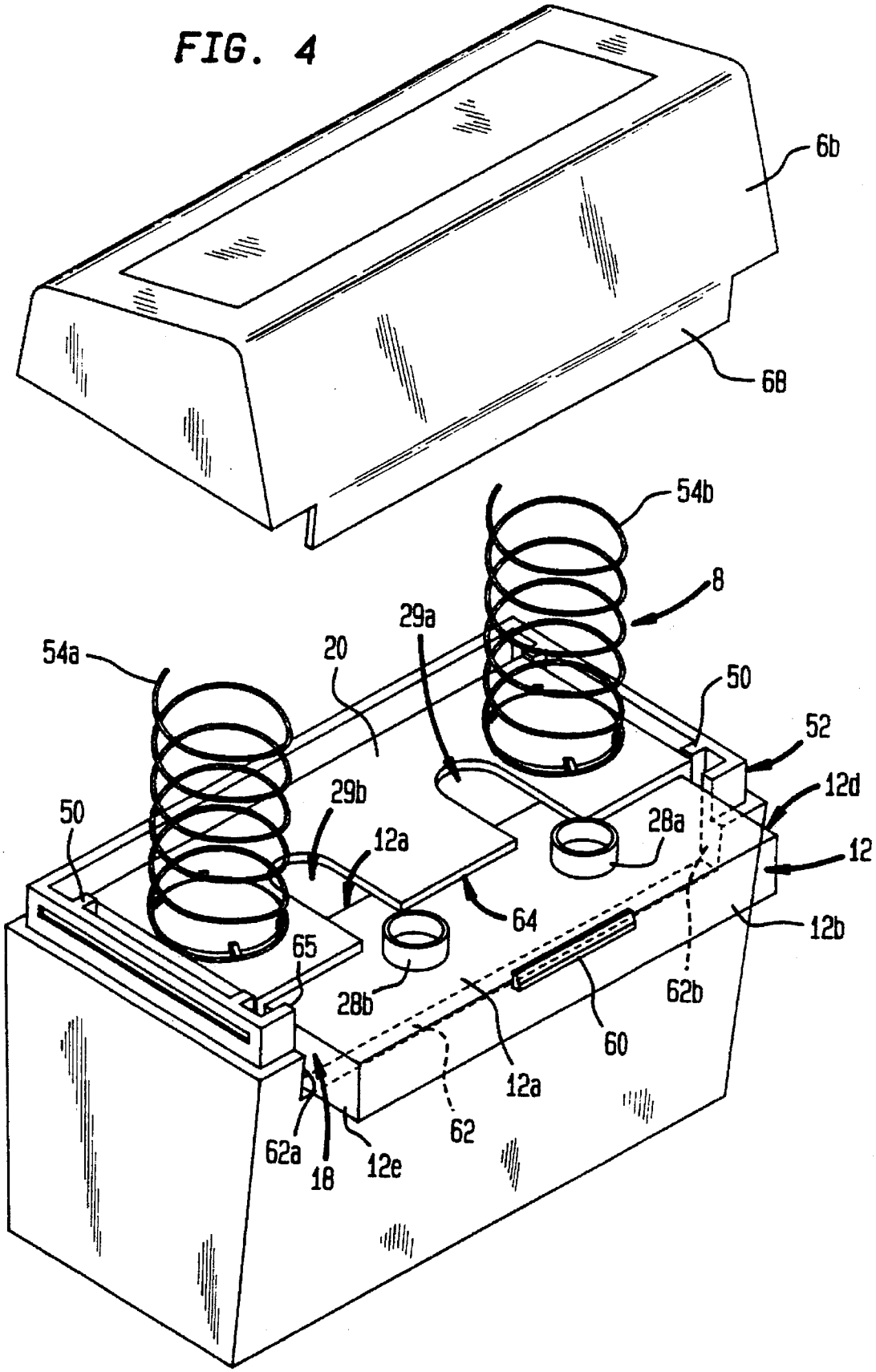
FIG. 4 is a rear perspective, exploded view of the self-inking stamp shown in FIG. 2.

In the embodiment of the invention shown in FIGS. 2 through 4, the operating member 5 includes at its top end a rim portion 52 having a reduced thickness as compared to the walls of encasement 6*a*, and which fits inside and holds in place the cover member 6*b* so that the cover member is removably engaged onto the upper end of the encasement 6*a*.

A highly important element of the present invention relates to the application, use and connection of the spring means 8 previously discussed. In particular, the two spring member 54*a* and 54*b* shown in FIG. 2, for example, are affixed in a permanent manner to the upper wall 20 of the frame member 1. In particular, coil springs 54*a* and 54*b* include a free upper end and a lower end which preferably surrounds central locating disks 56*a* and 56*b* and is affixed to the upper surface 20 of the frame member 1 by means of outwardly extending fingers 57 extending from the central locating disks 56*a* and 56*b* to the upper surface of the lowest coil of coil springs 54*a* and 54*b* to permanently affix this end of the coils to the upper wall 20 of the frame member 1. As can again be seen in FIG. 2, upon removal of the cover member 6*b* from the operating member 5, the coil springs 54*a* and 54*b* are now rendered inactive. Thus, where they previously were compressed between the upper wall portion 20 of the frame member 1 and the inner surface of the cover member 6*b*, they are no longer compressed, but at the same time remain affixed to the upper wall surface 20 of the frame member 1 in the manner discussed herein.

Further in this manner, the location operation of the coil springs 54*a* and 54*b* do not interfere with the removal of the ink pad 10 in its removable tray 12 from its position at the upper end of the frame member 1 below upper wall portion 20 thereof.

This can be contrasted again, for example, to the arrangement shown in the '281 patent, in which the lowermost coils of the springs are connected with the ink pad holder 6 shown therein, such as by being fitted onto and gripping the upwardly protruding backing portions shown in that patent. Therefore, in accordance with that device, in order to remove the ink pad, it is necessary to remove the closure from the operating member, remove the bridge member 60 shown therein from the rim 55, and then remove the springs and the ink pad holder thereof as a unit. Quite significantly, however, in accordance with the present invention, none of this is any longer necessary.

Figure 8:
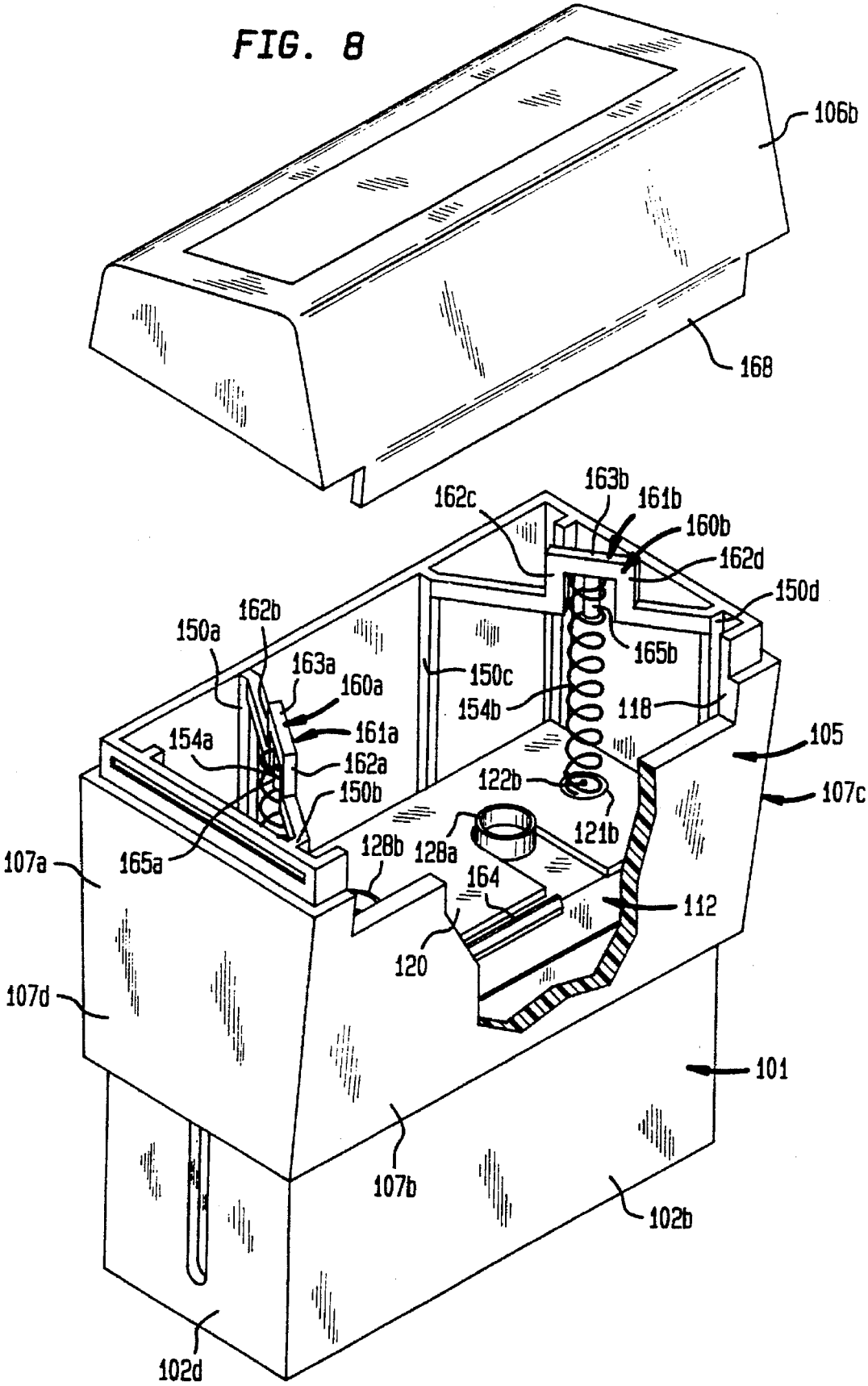
FIG. 8 is a rear perspective, exploded, partially cut-away view of another embodiment of the self-inking stamp of the present invention.

It is further noted that whether or not the coil springs 54*a* and 54*b* are rendered inactive upon removal of the closure 6*b*, the advantages of the present invention, in terms of the ability to remove the ink pad 10 with its removable tray 12 independently of the springs, is also achieved. Thus, in another embodiment of the present invention as shown in FIG. 8, the springs therein, 154*a* and 154*b*, are affixed to both the top wall portion 120 of the frame member 11 and a pair of bridges 160*a* and 160*b* shown therein. This embodiment of the present invention will be discussed in more detail below.

Returning to the embodiment of FIGS. 1 through 4, in this embodiment removal of the ink pad 10 carried by removable tray 12 is facilitated by grasping handle 60 on the forward edge of removable tray 12 in the user's finger and pulling the removable tray 12 horizontally outwardly through slot 18. The combination of handle 60 on a slidably removable ink pad holder, such as removable tray 12, is another feature of the present invention that results in an advantage over prior art devices. In this regard, handle 60 facilitates efficient removal of removable tray 12 to minimize the risk of soiling one's fingers.

As can be seen in FIGS. 2 through 4, slot 18 in the rear wall 7*b* of encasement member 6*a* is defined by depressed top wall portion 62 of the rear wall 7*b*, and by side wall portions 62*a* and 62*b* extending through an area corresponding to a portion of the rim 52 at the upper end of the operating member 5. A corresponding slot 64 is provided in the frame member 1 so that when these slots 18 and 64 are aligned, the removable tray 12 can be removed therethrough. Furthermore, in this embodiment the cover member 6*b* is removed, the springs 54*a* and 54*b* are rendered inactive, and the operating member 5 thus falls to its lowest position with respect to the frame member 1. It is noted, however, that in this lowermost position, the bottom ends of the frame member and operating member may not be precisely in alignment. Indeed, it is expected that with the stamp die being present in the device, the bottom of the operating member when the stamp die is at its lowest, stamping position will be slightly above the bottom of the frame member, which is resting on the support surface itself. In this configuration, the slot 64 in frame member 1 is in alignment with the slot 18 in the operating member 5 and the ink pad removable tray 12 can be readily removed by being slid horizontally therefrom. In the case of the device shown in FIGS. 2 through 4, it is also required that the cover member 6*b* be initially removed. In this case, the reason for this is that the cover member 6*b* includes a depending skirt portion 68 which at least partially closes the slot 18 in the operating member 5 when the cover member 6*b* is in its locked position on rim portion 52. Thus, even where the slots in the frame member 1 and the operating member 5 are in alignment, in this embodiment, the removable tray 12 cannot be withdrawn until the cover member 6*b* has been removed, thus opening slot 18. In other embodiments of the present invention, however, this is not the case. This, again, will be discussed in more detail with respect to those embodiments below.

It can also be seen in the Figures, such as FIG. 4, that removal of the removable tray 12 is facilitated in the case where the removable tray 12 includes the open cup members 28*a* and 28*b* discussed above, by the inclusion of corresponding slots 29*a* and 29*b* in the top wall portion 20 of the frame member 1. Thus, the open cup members 28*a* and 28*b* can readily slide between a position where the removable tray 12 is fully contained within the frame member 1, as shown in FIG. 3, and a position where the tray is being removed therefrom, as shown in FIG. 4.

Turning to the embodiment shown in FIG. 8, in this embodiment, which also includes removable tray 112 for an ink pad 110, an arrangement is shown in which the spring members 154*a* and 154*b* remain active upon removal of the cover member 106*b* of operating member 105. Thus, in this case, bridge members 160*a* and 160*b* are provided to restrain the upper end of the spring members 154*a* and 154*b*. The bridge members 160*a* and 160*b* are specifically designed to compress the spring mechanism against the top wall portion 120 of the frame member 101, and to do so in a manner in which the removable tray 112 can not only be removed, but in which the open cup formations 128*a* and 128*b* thereon are accessible through the top of the operating member 105 when the cover member 106*b* has been removed, for purposes of re-inking without removal of the removable tray 112. Thus, this device can be re-inked in either manner, and the ink pad 110 can be removed with removable tray 112 for replacement if desired. This is accomplished in part by the bridge members 160*a* and 160*b*, and their respective spring members 154*a* and 154*b* being displaced to the side of the top wall portion 120 as compared to the location of open cup formations 128*a* and 128*b*.

Bridge members 160*a* and 160*b* are fixed across the upper end of the operating member 105. These bridge members extend between and are preferably integral with ribs 150 running vertically along the inner walls of the operating member 105. In this case, the bridge member 160*a* runs between a vertical rib member 150*a* on the inner surface of rear wall 107*b* of the operating member 105 and vertical rib member 150*b* on the inner surface at the front end of the side wall 107*d* of the operating member 105. Correspondingly, bridge member 160*b* runs between a vertical rib member 150*c* on the other side of the rear wall 107*b* of the operating member 105 from the rib member 150*a*, and rib member 150*d* on the inner surface at the front end of side wall 107*c* of the operating member 105. In each case, the bridge members 160*a* and 160*b* include a central elevated portion 161*a* and 161*b*, respectively, which act as a seat for the upper end of the spring members 154*a* and 154*b*. Thus, the central raised portions 161*a* and 161*b* include vertically extending side walls 162*a* and 162*b* and top wall 163*a* in the case of bridge member 160*a*, and corresponding vertically extending side walls 162*c* and 162*d* and horizontal top wall 163*b* in the case of bridge member 160*b*. Depending downwardly from the lower surface of the top walls 163*a* and 163*b* are pegs 165*a* and 165*b*, respectively, upon which the spring members 154*a* and 154*b* are located at their upper end. At the lower end of the spring members 154*a* and 154*b*, they can be located at the desired position on the top wall portion 120 of the frame member 101 by means of recessed portions 121*a* and 121*b* thereon, with centering raised portions 122*a* and 122*b* concentrically disposed within recessed portions 121*a* and 121*b*, so that the lower end of the spring members 154*a* and 154*b* can be snap fitted into depressed portions 121*a* and 121*b* for proper alignment and retention.

In this embodiment, in order to remove the removable tray 112 with the ink pad 110 therein, it is necessary to remove the cover member 106*b*, since its depending skirt portion 168 once again blocks the slot 118 in the rear wall 102*a* of the operating member 105, and to then press downwardly on the operating member 105 against the resistance pressure of the spring members 154*a* and 154*b* until the bottom ends of the operating member 105 and the frame member 101 are at the lowest positions, so that the slot 118 is now in alignment with the corresponding slot 164 in the frame member 101, whereby while holding the operating member in this lower configuration, the removable tray 112 can readily slide out through these corresponding slots.

In connection with the device shown in the '281 patent, the upper ends of the spring members are retained by a particular type of bridge member which spans the upper end of the rim of the operating member thereof, such as that shown in FIG. 10 hereof and discussed more fully below. Thus, in the case of this stamp die of the '281 patent, access to the open cups is through the center of the springs, as can be seen in FIG. 1 thereof, and through openings in the bridge member itself aligned therewith. In the present invention, however, the unique bridge members 160*a* and 160*b* hereof are arranged so as to leave ready access to the open cup members 128*a* and 128*b* in the central portion of the operating member 105, separate and apart from the spring members 154*a* and 154*b*, which are displaced to the side of open cup members 128*a* and 128*b*. This permits the removable tray 112 to be removed from the device while the spring members 154*a* and 154*b* remain active, in this case between the top wall member 120 of the frame member 101 and the bridge members 160*a* and 160*b*.

Figure 9:
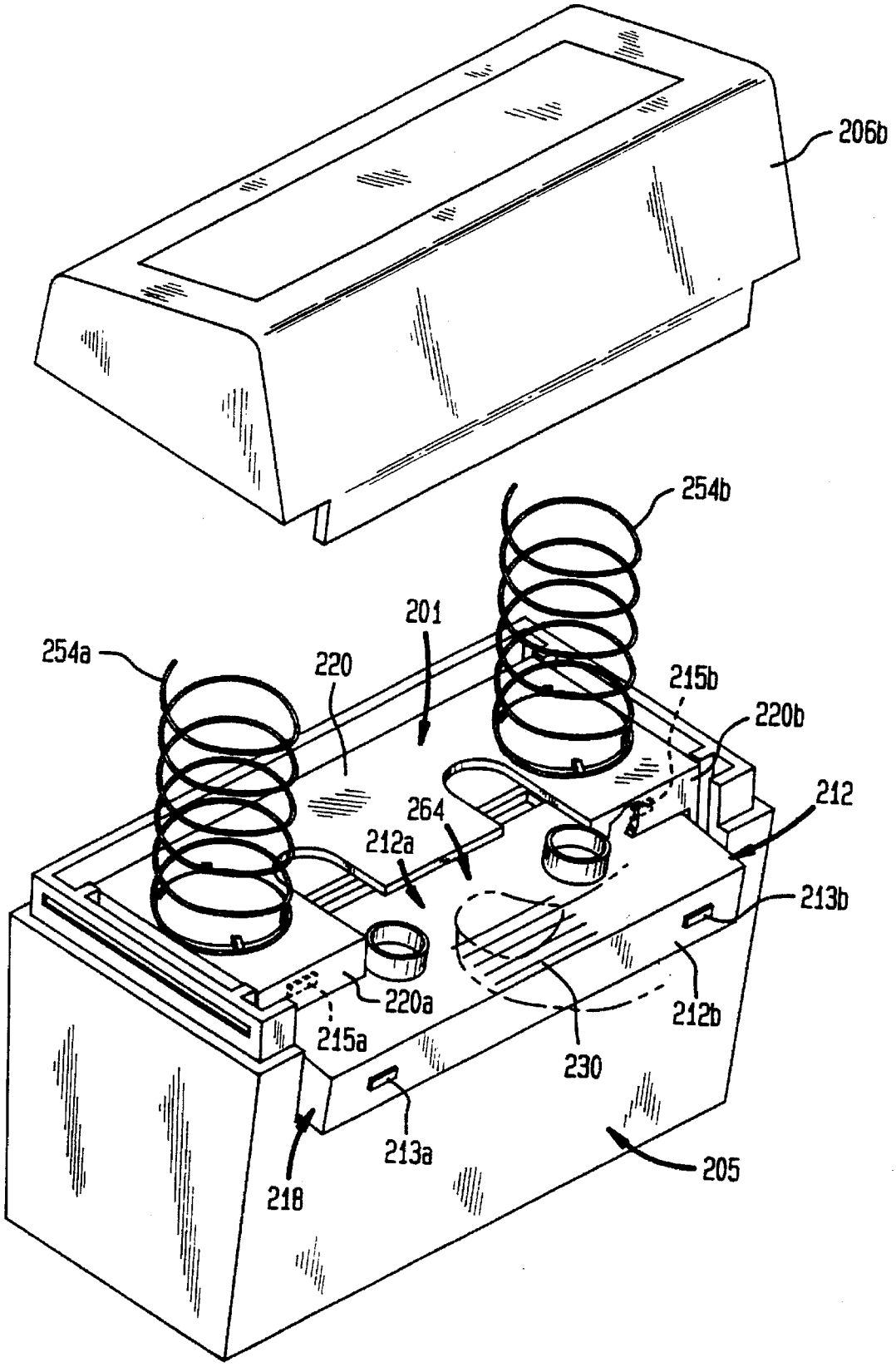
FIG. 9 is a rear perspective, exploded view of another embodiment of the self-inking stamp of the present invention.

Turning next to FIG. 9, a device which corresponds in many respects to the device shown in FIGS. 2 through 4 and discussed above is shown. However, in this case, the mechanism for retention of the removable tray 212 within the device is somewhat different. Here, when the removable tray 212 is in its closed position, below the upper wall portion 220 of the frame member 201, temporary locking means is provided to temporarily lock the removable tray 212 in that position. In this case, the upper wall portion 220 includes depending skirt portions 220*a* and 220*b* on either side of the front portions thereof, blocking portions of the slot 264 in the frame member 101. Furthermore, the front end 212*b* of the removable tray 212 includes a pair of raised tabs 213*a* and 213*b* extending therefrom. Correspondingly, the inner walls of the depending skirt portions 220*a* and 220*b* include correspondingly shaped indented portions 215*a* and 215*b* for receiving the extending tabs 213*a* and 213*b* in a snap-fit configuration. When it is therefore desired to remove the removable tray 212 from this self-inking stamp, the cover member 206*b* is removed, thus deactivating the spring members 254*a* and 254*b*, therefore also permitting the lower end of the operating member 205 to drop downwardly towards the lower end of the frame member 201, therefore aligning the slot 218 in the operating member 205 with the slot 264 in the frame member 201.

Furthermore, in this case the slot 218 in the operating member 205 must be a deeper slot, since it must be adequate to provide room for the removable tray 212 to exit therefrom; i.e., apart from the necessity to provide access for the total thickness of the removable tray 212 itself, it additionally requires further room to compensate for the distance of the length of the depending skirts 220*a* and 220*b*, so that the removable tray 212 can clear the bottom edge of these skirts and still fit within the slot 218 for removal therefrom. Removal of the removable tray 212 can then be effected by using roughened portion 230 as a grip for a thumb, as shown in FIG. 9, to initially push downwardly so as to unlock the temporary locking mechanism as between tabs 213*a* and 213*b* and recesses 215*a* and 215*b*, and to then pull outwardly to slide the removable tray 212 out of the opening provided by corresponding slots 264 and 218.

Figure 10:
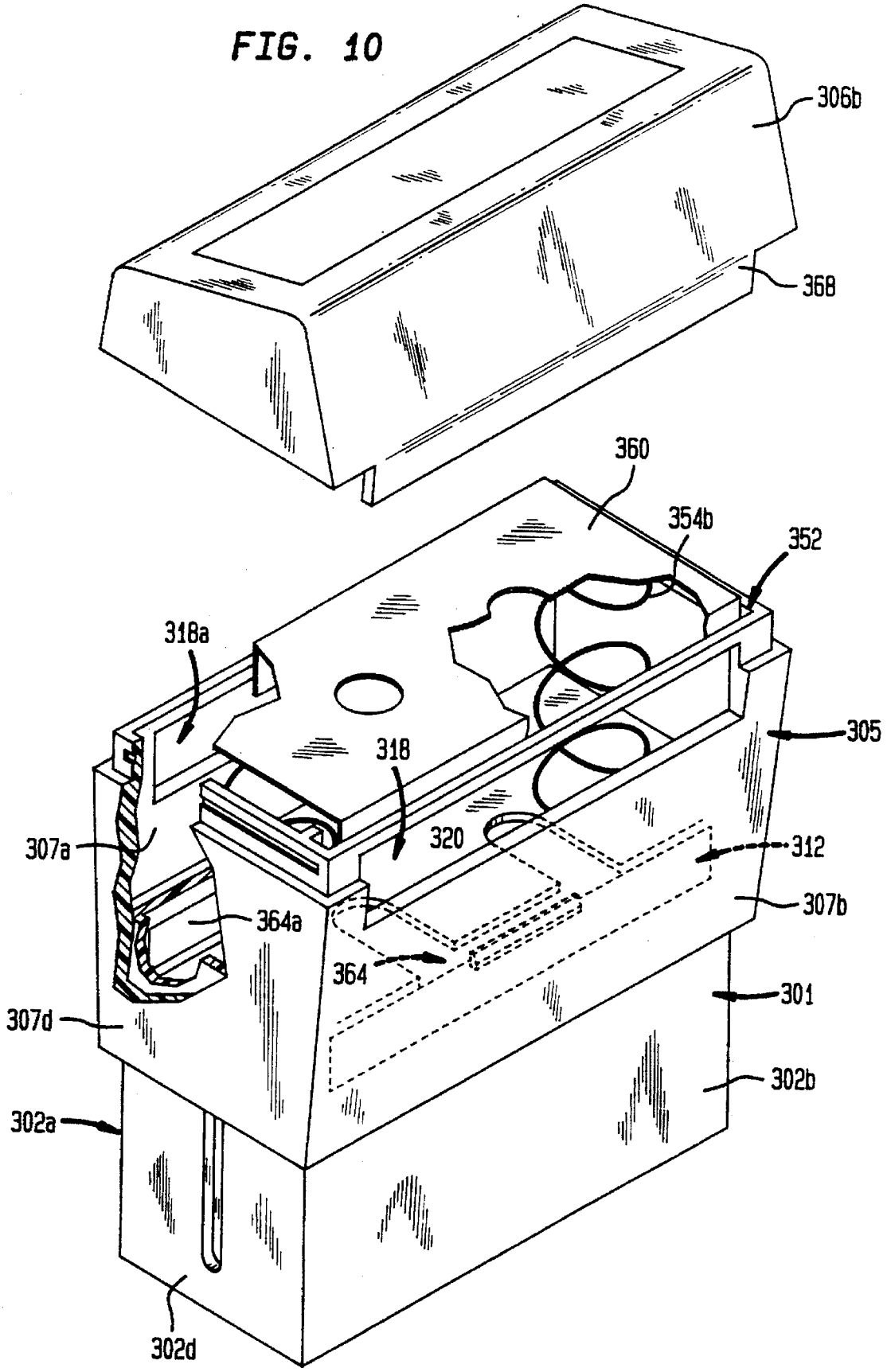
FIG. 10 is a rear perspective, exploded, partially cut-away view of another embodiment of the self-inking stamp of the present invention.

Another embodiment of the self-inking stamp of the present invention is shown in FIG. 10. In this embodiment, a bridge member 360 is employed which is similar to the bridge member given reference numeral 60 in the '281 patent, and specifically shown in FIGS. 1 through 3 thereof. In this case, the spring members 354*a* and 354*b* are compressed between bridge member 360 and the upper wall portion 320 of the frame member 301. The details of bridge member 360, and the way in which it is removably affixed to the rim portion 352 of the operating member 305, are disclosed in the '281 patent at column 6, lines 18 through 46, which is incorporated herein by reference thereto.

As contrasted to the device shown in the '281 patent, however, in the case of the embodiment in FIG. 10, it is still possible to remove the removable tray 312 while the spring members 354*a* and 354*b* remain active; i.e., in a compressed state, once again in this case by pressing downwardly on the operating member 305 until the slot 364 in the rear wall of the frame member 301 is in alignment with the slot 318 in the rear wall of the operating member 305, i.e., again in this case when the bottom ends of the frame member 301 and the operating member 305 are at their lowermost respective positions. In this case, that configuration is shown in FIG. 11, with the removable tray 312 now partially removed from the device though these corresponding slots, which are now in alignment as shown therein.

Figure 11:
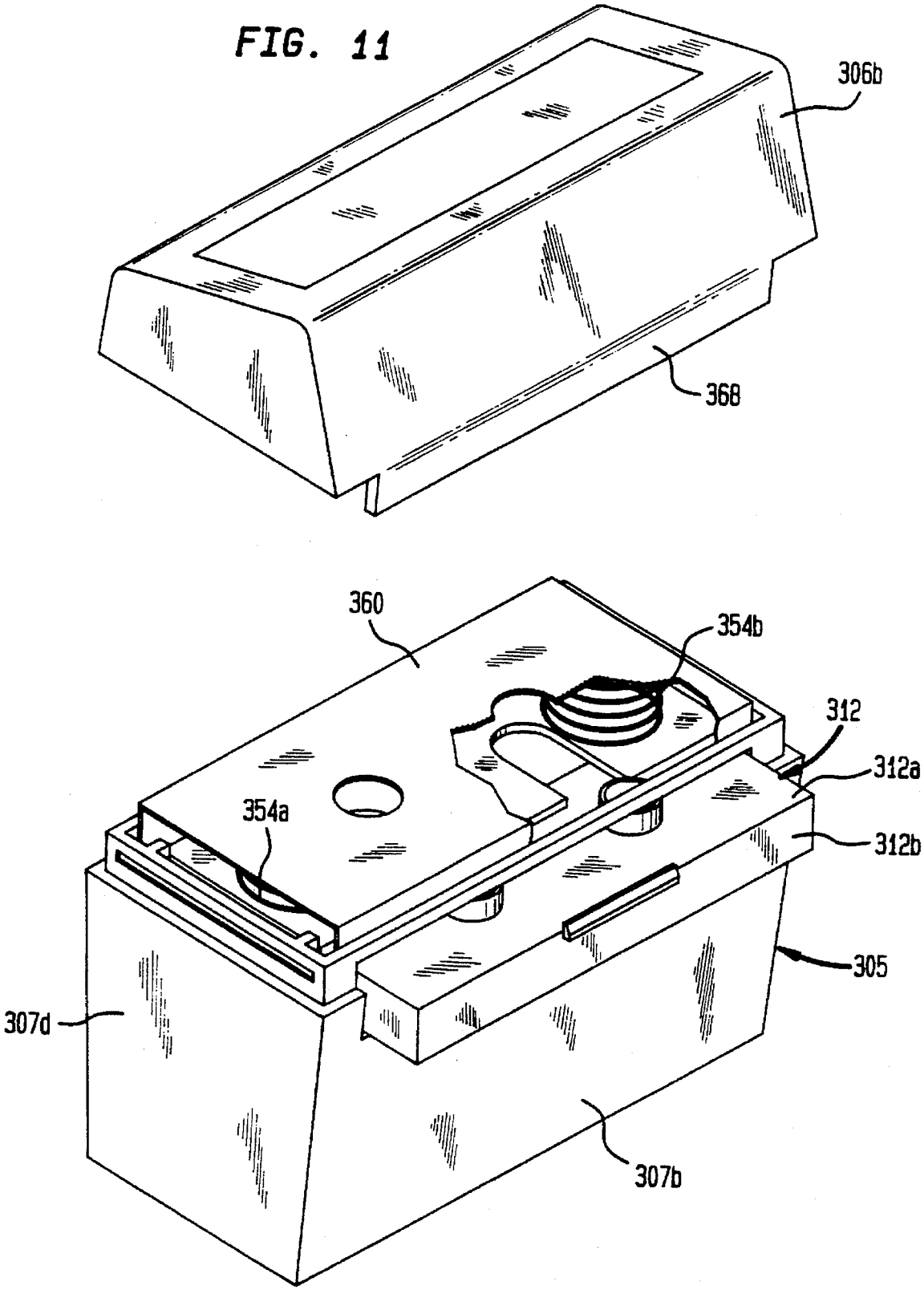
FIG. 11 is a rear perspective, exploded, partially cut-away view of the self-inking stamp shown in FIG. 10 with the operating member depressed for removal of the removable tray with the ink pad thereon.

It is also noted that in the configuration shown in FIGS. 10 and 11, removal of the removable tray 312 is facilitated by slots not only in the rear walls 302*b* and 307*b* of the frame member 301 and the operating member 305, respectively, but also in the front walls 302*a* and 307*a* of the frame member 301 and the operating member 305, respectively. Thus, additional slot 318*a* is included in the front wall 307*a* of the operating member 305, at a location corresponding to the slot 318 in the front wall thereof. Similarly, a further slot 364*a* is located in the front wall 302*a* of the frame member 301 at a location corresponding to the slot 364 in the front wall thereof. In this manner, removal of the removable tray 312 is facilitated by being able to push the tray through the aligned slots 318*a* and 364*a* until it extends out of the front slots 318 and 364, so that it can be readily pulled therefrom, again into the configuration shown in FIG. 11.

Figure 12:
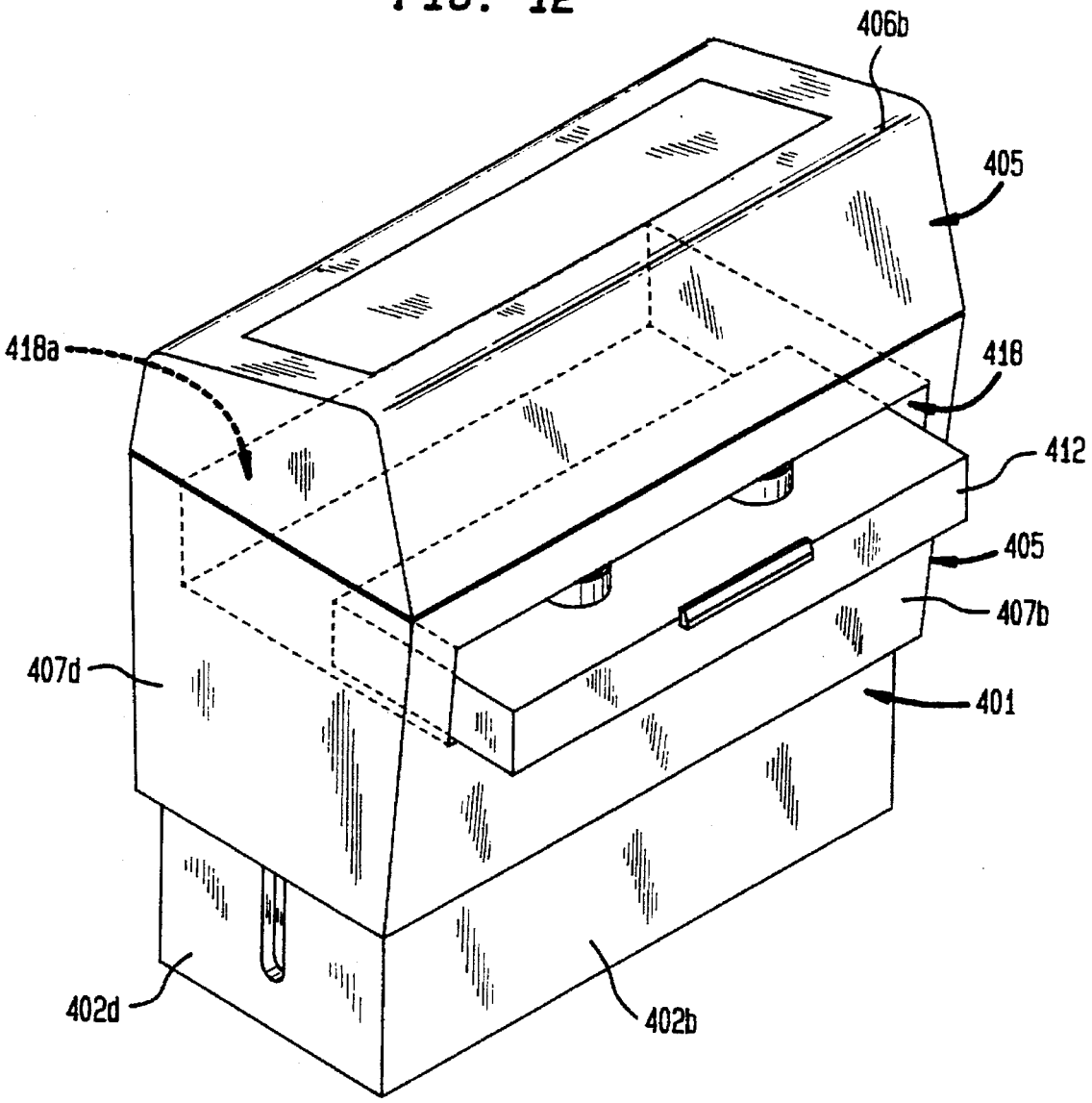
FIG. 12 is a partial rear perspective view of another embodiment of the self-inking stamp of the present invention.

Turning to FIG. 12, a similar device is shown, but in this case it is noted that, unlike a number of the devices discussed above, the location of the slots in the frame members and operating members are below the location of the cover, i.e., at a location lower along the front and rear walls of the frame members and operating members from those shown in these other embodiments, so that it is not necessary to remove the cover member 406*b* from this configuration in order to align the slots and remove the removable tray therefrom. Thus, in these devices it is not necessary to have a removable cover at all, and a single continuous operating member 405 could be used, with an integral cover 406*b* that is not removable therefrom. In such a configuration, the removable tray 412 as seen in FIG. 12 can be removed by lowering the operating member 405 by pushing downwardly a partial distance; i.e., only until the corresponding slots 464 in the rear wall 402*b* in frame members 401 and 418 in the rear wall 407*b* in operating member 405 are in alignment, and where applicable similar corresponding slots 464*a* in the front wall 402*a* of the frame members 401 and slot 418*a* in the front wall 407*a* of the operating member 405 are in alignment, so that the removable tray 412 can be removed in a similar manner to that described in connection with the embodiment set forth in FIGS. 10 and 11 and discussed above.

As shown in FIGS. 4, 9, 11 and 12, preferred embodiments of the present self-inking stamp comprise a removable ink pad holder (12, 212, 312, 412) which may be releasably mounted on the frame (1, 201, 301, 401) in a manner sufficient to permit it to be easily removed therefrom while the additional structure of the self-inking stamp remains substantially intact. To this end, the removable ink pad holder (12, 212, 312, 412) of FIGS. 4, 9, 11 and 12, respectively, may be at least partially removed from its mounted position on the frame (1, 201, 301, 401) while all of most of the other components of the self-inking stamp remain in assembled position.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A self-inking stamp comprising:

a frame; an operating member slidably mounted relative to said frame member: at least one spring arranged between said operating member and said frame; a removable ink pad holder releasably mounted on said frame in a manner sufficient to permit it to be at least partially displaced from its fully assembled position on said frame while the remaining structure of said self-inking stamp remains intact; and an ink pad retained by said removable ink pad holder for providing ink impressions during operation of said self-inking stamp, said removable ink pad holder including inking means for receiving and facilitating the distribution of ink to said ink pad while said removable ink pad holder is in its at least partially disassembled position with respect to said frame.

2. The self-inking stamp of claim 1 wherein said inking means is arranged to allow reinking of said ink pad while said removable ink pad holder is completely disassembled from said frame.

3. The self-inking stamp of claim 1 wherein said inking means comprises at least one open cup member arranged on said removable ink pad holder.

4. The self-inking stamp of claim 1 wherein said removable ink pad holder comprises a tray defining a cavity, said ink pad being secured to said tray within said cavity thereof.

5. The self-inking stamp of claim 1 wherein said removable ink pad holder includes handle means for facilitating removal of said ink pad holder from its assembled position on said frame.

6. A method of reinking a self-inking stamp comprising the steps of: providing a self-inking stamp including a frame, an operating member slidably mounted relative to the frame, at least one spring arranged between the operating member and the frame, a removable ink pad holder having inking means thereon releasably mounted on the frame, and an ink pad retained by the removable ink pad holder; at least partially removing the ink pad holder and the accompanying ink pad from said self-inking stamp while the remaining structure of said self-inking stamp remains intact, and placing ink through said inking means of said ink pad holder to be absorbed by said ink pad while said ink pad holder is at least partially disassembled from said self-inking stamp.

7. The method of claim 6 wherein said step of removing said ink pad holder and said accompanying ink pad comprises sliding said ink pad holder out of its assembled position on said frame of said self-inking stamp.

8. The method of claim 6 wherein said inking means comprises at least one open cup member, said step of placing ink on said ink pad comprises placing ink through said at least one open cup member.

9. The method of claim 6 wherein said ink pad holder comprises handle means, said step of removing said ink pad holder and said accompanying ink pad includes grasping said handle and sliding said ink pad holder, from said frame of said self-inking stamp.

10. The method of claim 6 wherein said step of removing said ink pad holder and said accompanying ink pad comprises disassembling said ink pad holder from its assembled position on said frame of said self-inking stamp.

11. The method of claim 6 wherein said step of placing ink through said inking means is performed while said ink pad holder is completely disassembled from said self-inking stamp.

12. A self-inking stamp comprising:

a frame; an operating member slidably mounted relative to said frame, said operating member including an encasement and a cover member removably mounted on said encasement; at least one spring arranged between said operating member and said frame; a removable ink pad holder releasably mounted on said frame in a manner sufficient to permit it to be at least partially displaced from its fully assembled position on said frame while only the cover member of said operating member and any components which may be attached thereto is disassembled from the remaining structure of said self-inking stamp; and an ink pad retained by said removable ink pad holder for providing ink impressions during operation of said self-inking stamp, said removable ink pad holder including inking means for receiving and facilitating the distribution of ink to said ink pad while said removable ink pad holder is in its at least partially disassembled position with respect to said frame.

13. The self-inking stamp of claim 12 wherein said inking means is arranged to allow reinking of said ink pad while said removable ink pad holder is completely disassembled from said frame.

14. The self-inking stamp of claim 12 wherein said inking means comprises at least one open cup member arranged on said removable ink pad holder.

15. The self-inking stamp of claim 12 wherein said removable ink pad holder comprises a tray defining a cavity, said ink pad being secured to said tray within said cavity thereof.

16. The self-inking stamp of claim 12 wherein said removable ink pad holder includes handle means for facilitating removal of said ink pad holder from its assembled position on said frame.

17. A method of reinking a self-inking stamp comprising the steps of: providing a self-inking stamp including a frame, an operating member slidably mounted relative to the frame, said operating member including an encasement and a cover member removably mounted on said encasement; at least one spring arranged between the operating member and the frame, a removable ink pad holder having inking means thereon releasably mounted on the frame, and an ink pad retained by the removable ink pad holder; at least partially removing the ink pad holder and the accompanying ink pad from said self-inking stamp while only the cover of the operating member and any components which may be attached thereto, is removed from the remaining structure of the self-inking stamp, and placing ink through said inking means of said ink pad holder to be absorbed by said ink pad while said ink pad holder is at least partially disassembled from said self-inking stamp.

18. The method of claim 17 wherein said step of removing said ink pad holder and said accompanying ink pad comprises sliding said ink pad holder out of its assembled position on said frame of said self-inking stamp.

19. The method of claim 17 wherein said inking means comprises at least one open cup member, said step of placing ink on said ink pad comprises placing ink through said at least one open cup member.

20. The method of claim 17 wherein said ink pad holder comprises handle means, said step of removing said ink pad holder and said accompanying ink pad includes grasping said handle and sliding said ink pad holder from said frame of said self-inking stamp.

21. The method of claim 17 wherein said step of removing said ink pad holder and said accompanying ink pad comprises disassembling said ink pad holder from its assembled position on said frame of said self-inking stamp.

22. The method of claim 17 wherein said step of placing ink through said inking means is performed while said ink pad holder is completely disassembled from said self-inking stamp.

* * * * *